US005700972A

United States Patent [19]

Saxby

[11] Patent Number: 5,700,972

[45] Date of Patent: Dec. 23, 1997

[54] GAS CARTRIDGE

[75] Inventor: Michael Ernest Saxby, East Sussex, Great Britain

[73] Assignee: Constantia (International) Limited, Queenway, Gibraltar

[21] Appl. No.: 596,303

[22] PCT Filed: Aug. 15, 1994

[86] PCT No.: PCT/GB94/01779

§ 371 Date: Feb. 13, 1996

§ 102(e) Date: Feb. 13, 1996

[87] PCT Pub. No.: WO95/05573

PCT Pub. Date: Feb. 23, 1995

[30] Foreign Application Priority Data

Aug. 16, 1993 [GB] United Kingdom ..... 9317040

[51] Int. Cl.[6] ..... F42B 5/02; F41B 11/06

[52] U.S. Cl. ..... 102/440; 102/444; 124/57; 124/74; 124/75; 222/3

[58] Field of Search ..... 102/430, 440, 102/444; 124/57, 70, 71, 73, 74, 75, 76; 222/3

[56] References Cited

U.S. PATENT DOCUMENTS

| | | | |
|---|---|---|---|
| 387,256 | 8/1888 | Pratt | 102/430 |
| 2,327,653 | 8/1943 | Lisle | 102/430 |
| 4,531,458 | 7/1985 | Saxby | 102/440 |
| 5,492,063 | 2/1996 | Dittrich | 102/444 |

FOREIGN PATENT DOCUMENTS

| | | | |
|---|---|---|---|
| 0189974 | 8/1986 | European Pat. Off. . | |
| 0499332 | 8/1992 | European Pat. Off. . | |
| 2369537 | 5/1978 | France . | |
| 2403536 | 4/1979 | France . | |
| 2822624 | 12/1978 | Germany | 102/444 |
| 1601918 | 11/1981 | United Kingdom . | |
| 2116681 | 9/1983 | United Kingdom . | |
| 2153983 | 8/1985 | United Kingdom . | |
| 2154714 | 9/1985 | United Kingdom . | |
| 2211588 | 7/1989 | United Kingdom . | |

*Primary Examiner*—Harold J. Tudor
*Attorney, Agent, or Firm*—Dowell & Dowell

[57] ABSTRACT

A cartridge has a case comprising a body (10) housed telescopically within a sleeve (14). The body encloses a main chamber (21) which contains gas under pressure, and a valve mechanism for venting gas from the chamber (21) into an expansion chamber (61). The pressure of the gas in the expansion chamber causes the body (10) to move rearwardly relative to the sleeve (14) to apply a force to the breech block of the weapon in which the cartridge is used, thereby to initiate the reloading cycle. Gas is vented from the expansion chamber to eject a projectile when a spigot (51) projecting from the body is withdrawn from an aperture (53) in the end wall of the sleeve.

5 Claims, 4 Drawing Sheets

GAS CARTRIDGE

BACKGROUND OF THE INVENTION

1. Field of the Invention

The present invention relates to pressurised gas cartridges of the type which may be used in place of conventional pyrotechnic cartridges.

2. History of the Related Art

Pressurised gas cartridges are known, one example being that disclosed in European Patent specification EP-A-499332, to which reference should be made. A disadvantage of the known types of gas cartridges is that they are incapable of generating sufficient rearward force to actuate recoil-operated automatic and semi-automatic weapons. Such weapons depend upon the breech block being moved rearwardly under force applied to it upon firing of a round of ammunition in order to set in train the reloading and recocking cycle.

SUMMARY OF THE INVENTION

To overcome this problem it is proposed herein that a gas cartridge should have a first part which is displaced on firing relative to a second part, so as to apply the necessary force to the breech block to recycle the weapon. In a preferred embodiment, gas used to eject a projectile from the cartridge disclosed in the above mentioned specification is admitted to an expansion chamber prior to being used to eject the projectile, where it acts on the rearwardly movable part.

Preferably the cartridge case is of telescopic construction and has a sleeve which is slidably mounted on a body housing the gas chambers and operating parts. The sleeve may have a forward end wall which overlies the forward end wall of the body, and the expansion chamber is defined between the two end walls. The pressure of gas in the expansion chamber acts on the end wall of the body and drives the body rearwardly in the manner of a piston. The sleeve is held in place by engagement with the wall of the chamber of the weapon. The gas is subsequently discharged from the expansion chamber and used to eject the bullet or other projectile. The moment at which the gas is discharged from the expansion chamber is preferably determined by the sleeve and body entering predetermined relative positions. To this end, the body may have an axially extending spigot which normally projects into and obturates an aperture in the end wall of the sleeve. The relative movement between the sleeve and body leads to the spigot being progressively withdrawn from the aperture until, in the predetermined relative positions, the spigot is withdrawn from the aperture and the gas from the expansion chamber exhausts through it. Although the bullet or other projectile may be held in place to the rim of the sleeve in a conventional way, it may alternatively be fitted to the spigot from which it is released at the instant the pressurised gas is applied to the projectile. Other arrangements for causing a part of a cartridge to be displaced rearwardly may be used in place of that described above.

DESCRIPTION OF THE DRAWING FIGURES

FIG. 1 is a longitudinal section through a pressurised gas cartridge in its charged state prior to firing, FIG. 2 shows the parts in their relative positions shortly after firing, FIG. 3 shows the parts in their relative positions at the end of the firing sequence, and FIG. 4 is a schematic longitudinal cross-section through a portion of a weapon loaded with a gas cartridge according to the present invention.

DESCRIPTION OF THE PREFERRED EMBODIMENT

The preferred embodiment of the invention will be described in the context of the cartridge disclosed in the above-mentioned specification to which reference should be made for a full understanding of the operating mechanism and its manner of operation.

Figure 1:
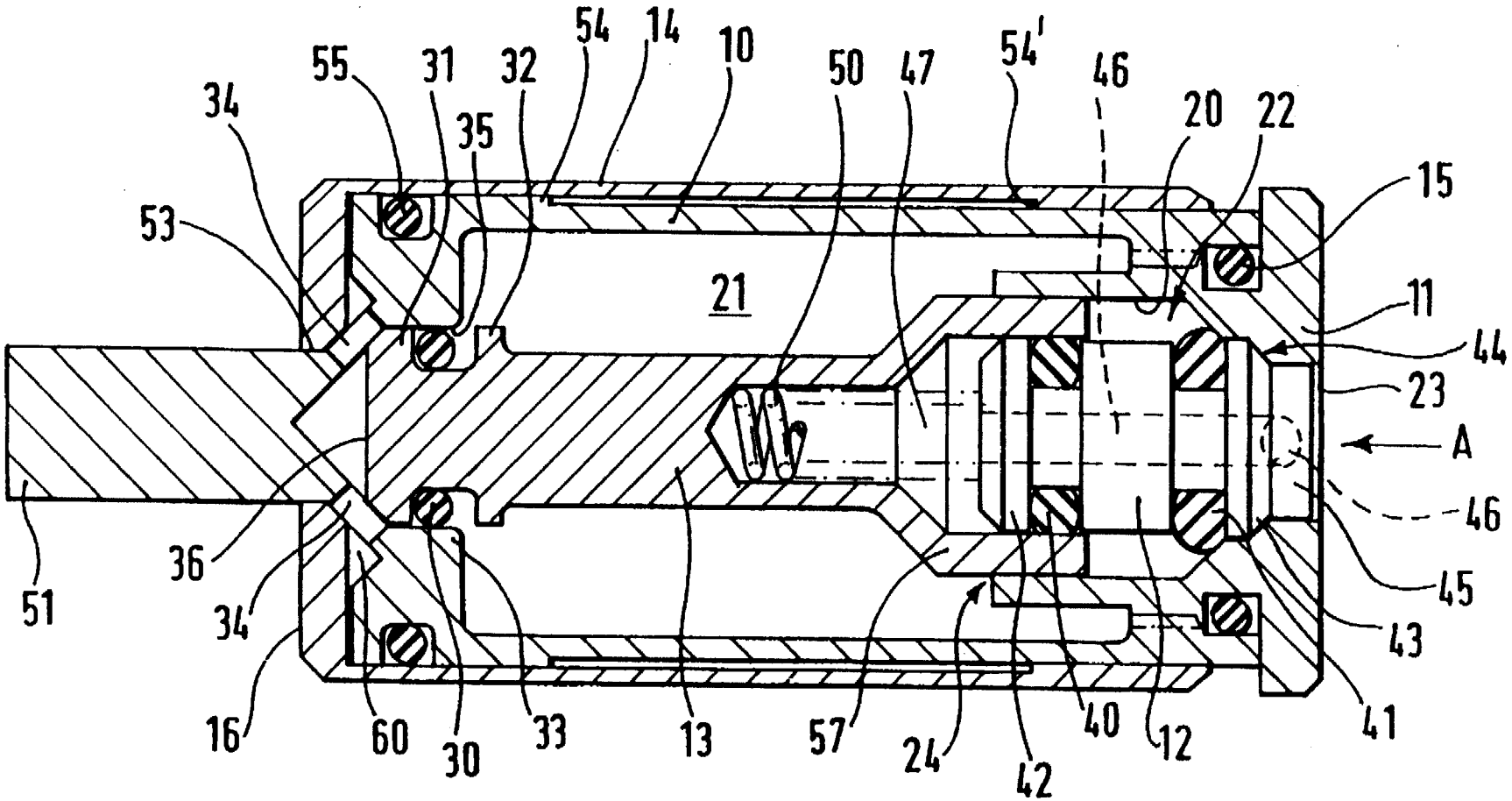
Figure 4:
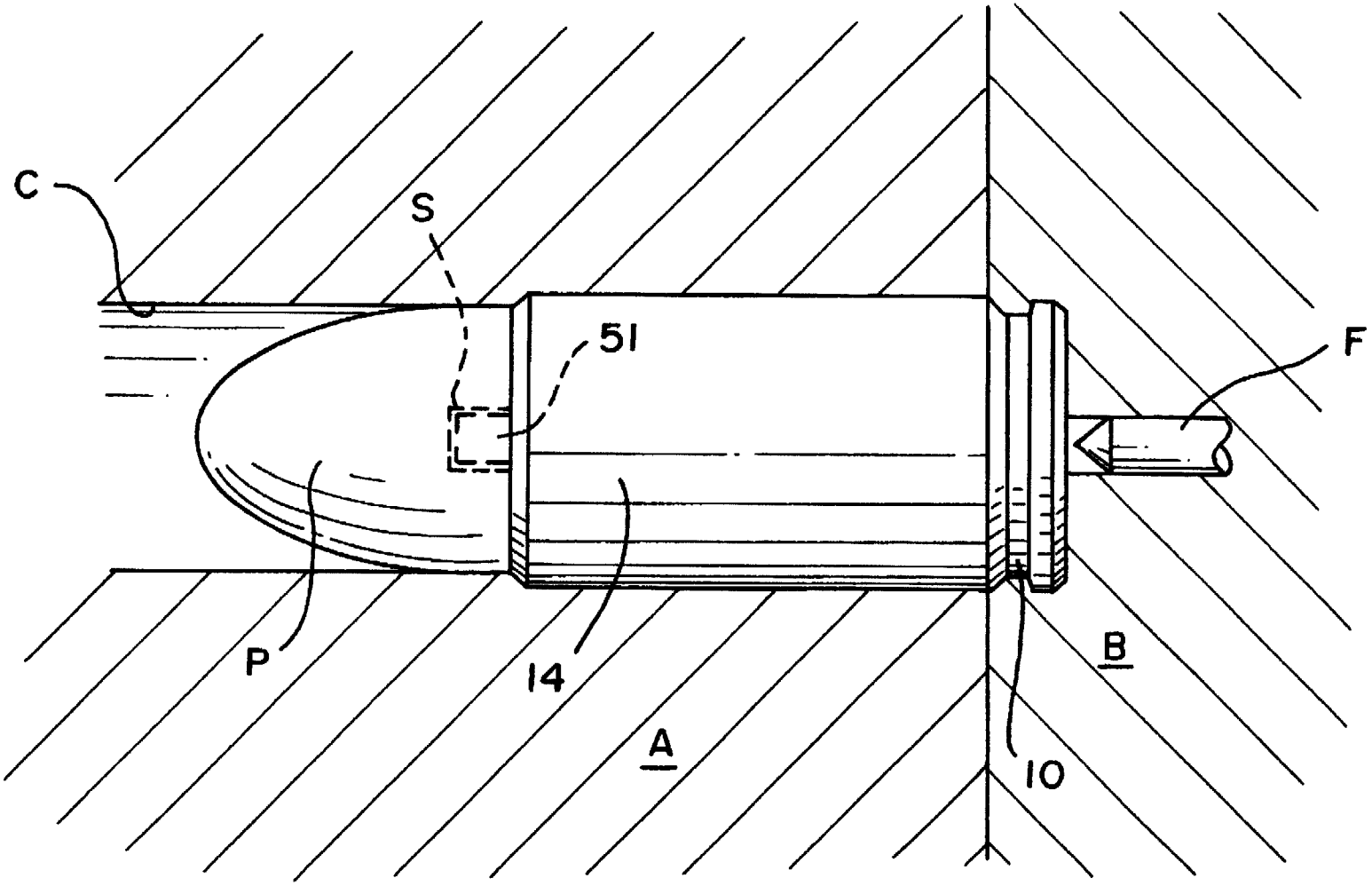

Referring to FIGS. 1 and 4, the cartridge proposed herein has a two-part case formed from a body 10 and a sleeve 14 mounted telescopically on the body. A projectile "P" is disposed at the forward end of the cartridge. In use, the cartridge is loaded into the chamber "C" of a conventional gun having a barrel "A", breech block "B" and firing pin "F", all shown in FIG. 4. The sleeve has a radially inwardly extending wall 16 at its forward end which bounds an aperture 53. Because the cylindrical portion of the sleeve is not under any gas pressure it may have a relatively thin wall. The body is provided at its forward end with an external annular shoulder 54 arranged to cooperate with an internal shoulder 54' at the rearward end of the sleeve in order to limit relative movement of the two parts. An O-ring 55 seals the body to the sleeve at their forward ends.

The body has a radially inwardly extending front wall 33 at its forward end which in the charged state is in close contact with the end wall of the sleeve. An axial spigot 51 projects from the wall 33 and is a sliding fit in the aperture 53. The spigot functions as a slide valve and normally closes the aperture 53. A cavity 35 in the inner side of the wall 33 has a cylindrical portion which serves as a seat for the head 36 of a piston valve having a stem 13. The end wall of the cavity is conical in shape and formed with ports 34 opening into an annular V-sectioned groove in the outer surface of the end wall 33. The groove 60 forms a part of an expansion chamber to be described later. The valve head 36 is formed with a pair of collars 31, 32 defining a groove which receives an O-ring sealing the valve head against the cavity.

An insert 11 is screwed into the rearward end of the body and is sealed relative to the body by an O-ring 15. The insert has a cylindrical extension which defines a bore 20 which guides a skirt portion 57 at the rearward end of the stem 13. A primary gas chamber 21 surrounding the piston valve contains a gas, conveniently air, under a pressure which is preferably at least 50 bar ($5\times10^7$ Pa) and more preferably substantially 200 bar ($2\times10^7$ Pa).

In the charged state of the cartridge as shown in FIG. 1, the body and sleeve are in their closed positions with the two end walls juxtaposed.

Figure 2:
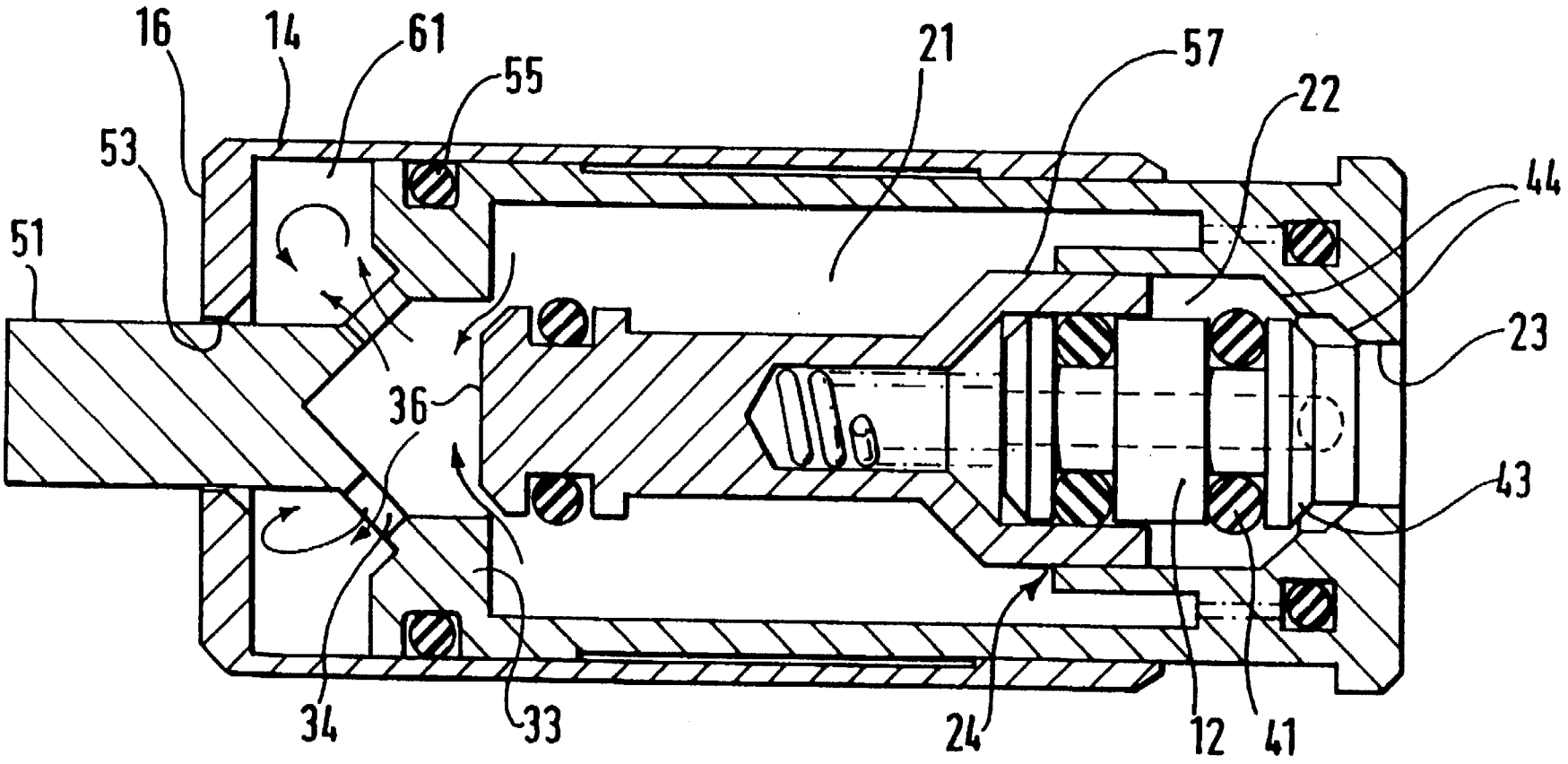
Figure 3:
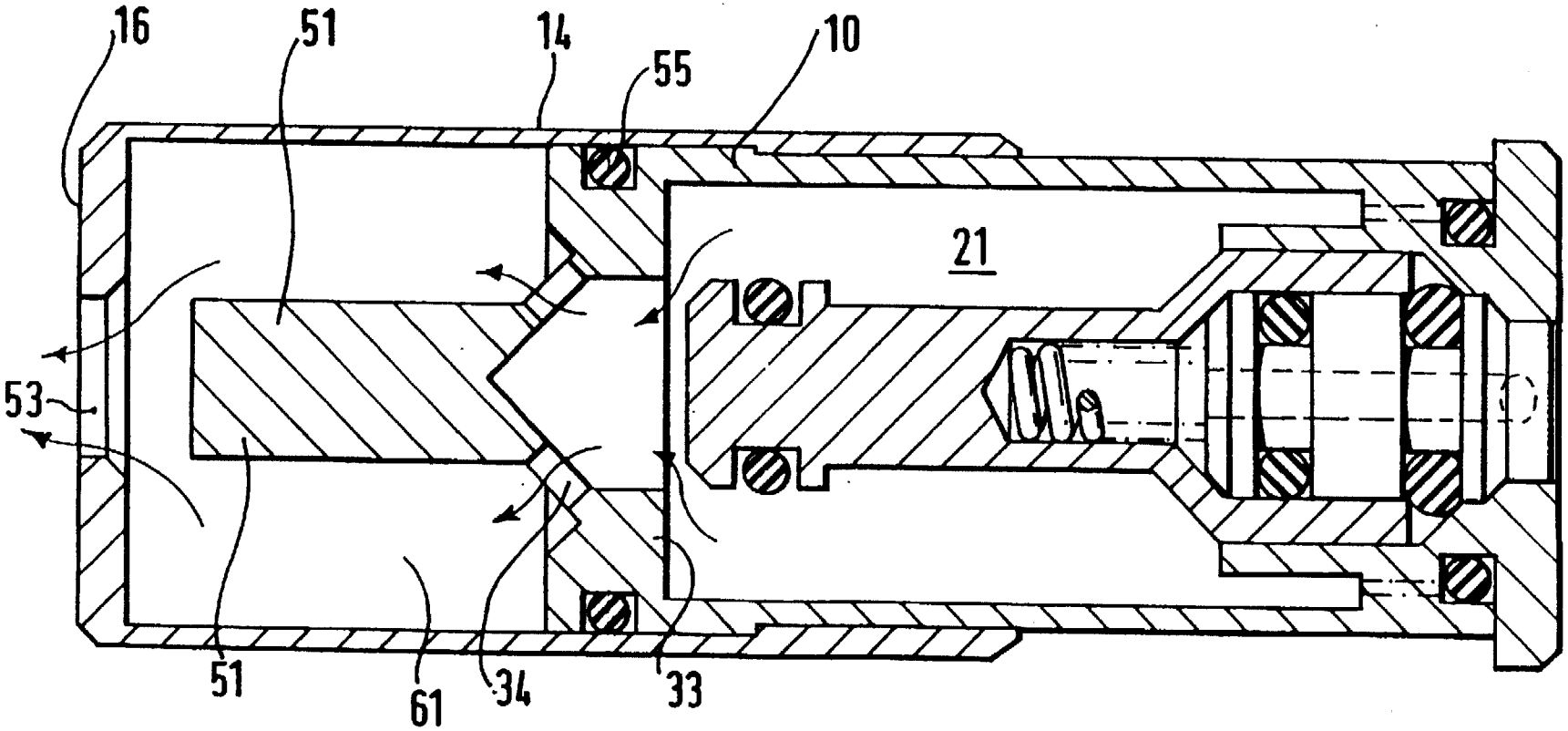

Upon the cartridge being fired, the piston valve is moved rearwardly, initially into the position shown in FIG. 2. The valve head 36 is therefore withdrawn from the cavity 35 and frees the ports 34. Gas from the primary chamber escapes into the groove 60 and causes the body to begin its rearward movement relative to the sleeve. This movement begins the enlargement of an expansion chamber 61 which continues to enlarge as rearward movement of the body continues. Gas is prevented from escaping between the body and sleeve by the O-ring 55. During this movement the spigot slides back through the aperture 53 until eventually it is withdrawn completely therefrom into the position shown in FIG. 3. The air from the expansion chamber now escapes through the aperture 53 and ejects the projectile "P" carried by the cartridge. The projectile "P" may be held in place by a lip on the rim of the wall 16, or may be provided with a socket "S" which receives the spigot 51. In the charged state of the cartridge as shown in FIG. 1, the body and sleeve are in their closed positions with the two end walls juxtaposed.

The operating mechanism for the cartridge is substantially as described in the above-mentioned specification and will therefore be described only briefly.

The rearward movement of the piston valve is initiated by displacement of a relief valve which comprises a spool member supported within the skirt 57 of the piston valve. The spool member has a central body portion 12 and forward and rearward shoulders 42, 43 defining grooves for receiving O-rings 40, 41. A stem portion 45 extends rearwardly from the shoulder 43 and is located within a relief passage 23. Frusto-conical valve seats 44 in the relief passage 23 are contacted by a complementary portion of the rearward shoulder and by the rearward O-ring. The forward O-ring 40 is sealed against the bore within the skirt 57. A compression spring 50 applies a relatively weak pressure to the spool member. Two chambers are thereby formed, namely a secondary chamber 22 located between the end of the skirt 57 and the seal ring 41 and third chamber 47 located within the skirt 57 forwardly of the shoulder 42. The chamber 22 is in communication with the primary chamber 21 through a bleed passage 24 existing between the skirt and the bore 20, so that in the charged state the pressures within the chambers 21 and 22 are equalised. A duct 46 extends through the spool member to connect the chamber 47 to a vent in the peripheral surface of the stem portion, whereby the chamber 47 is at atmospheric pressure.

Upon the stem portion 45 being struck by a firing pin "F" moving in the direction of the arrow "A", the spool member is propelled into the skirt, so lifting the rearward shoulder 43 and O-ring 41 from their seats.

Gas in the chamber 22 vents to atmosphere through the relief passage. Although some gas flows through the bleed passage 24 from chamber 21, this flow is negligible and does not prevent the pressure in the chamber 22 falling sharply. The gas in chamber 21 applies pressure to the forward surface of the skirt 57 which greatly overcomes that applied by gas in chamber 22 to the rearward rim of the skirt, and the piston valve tends to move rearwards, as discussed above. Because chamber 47 is at atmospheric pressure and able to vent through duct 46, the spool member is drawn into the skirt, thereby allowing the piston valve to move towards the position shown in FIG. 3.

By varying the length of the spigot 51 or the length of the body of the cartridge or the ratio of the former to the latter, the time at which gas is released and the projectile discharged may be adjusted relative to the rearward motion of the body.

A cartridge in accordance with the invention has the advantage over pyrotechnic cartridges that it is reusable. It is therefore very suitable for use as training ammunition, particularly for semi-automatic pistols and other recoil-operated weapons. The cartridge may also be particularly suitable for use in paint-ball guns, because the ball may be adapted easily to fit on the spigot 51. Although the cartridge has been described as being used to eject a projectile, it will be appreciated that it may be used as a "blank" without a projectile but will still be capable of applying force to the breech block "B".

Modifications may be made to the cartridge described herein within the scope of the invention. In particular, other types of valve arrangements may be employed to admit gas to the expansion chamber in response to the cartridge being struck by the firing pin, and other valve arrangements may be used to discharge gas from the expansion chamber and the desired instant.

I claim:

1. A pressurized gas cartridge comprising:

a body having a front wall;

a sleeve telescopically surrounding the body and having a forward wall positioned forwardly of the front wall of the body;

a first gas chamber within the body for containing gas under pressure;

an expansion chamber defined between the front wall of the body and the forward wall of the sleeve;

a passage between the gas chamber and the expansion chamber;

a first valve means in the front wall of the body and normally closing the passage and being moveable to open the passage in response to the impact on the cartridge of a firing pin to allow gas to flow through the passage from the gas chamber into the expansion chamber, thereby moving the body rearwardly relative to the forward wall of the sleeve;

a second normally closed valve means in the forward wall of the sleeve, said second normally closed valve means being operable to open in response to a predetermined relative movement between the body and the sleeve which takes place as gas enters the expansion chamber, thereby to vent gas through the second valve means from the expansion chamber, whereby the relative movement between the body and the sleeve increases the length of the cartridge, thus applying force to a breech block of a weapon in which the cartridge is used.

2. A pressurized gas cartridge as claimed in claim 1 wherein the second valve means comprises a valve member which extends from the front wall of the body into an aperture in the forward wall of the sleeve whereby relative movement of the sleeve and body causes the valve member to be withdrawn relative to the aperture.

3. A pressurized gas cartridge as claimed in claim 2 wherein the valve member is in the form of a spigot, and a projectile mounted to the cartridge, the projectile having a socket which receives the spigot.

4. A cartridge as claimed in any preceding claim wherein the first valve means includes a cavity in the front wall of the body and a valve head received in the cavity, the cavity having a conical end wall, the passage including a plurality of ports open through the front wall into the expansion chamber, the valve head being withdrawable from the cavity away from the forward wall of the sleeve by an operating mechanism responsive to movement of a stem mounted within the body adjacent a rear end thereof and which is positioned to be struck by the firing pin of the weapon.

5. A cartridge as claimed in claim 1 in combination with a recoil operated weapon having a moveable breech block, wherein during said relative movement, the body applies sufficient force to the breech block of the weapon to recycle the weapon.

* * * * *